US007775496B2

(12) United States Patent
Johnson

(10) Patent No.: US 7,775,496 B2
(45) Date of Patent: Aug. 17, 2010

(54) METAL SUPPORT COLUMN SHIPPING ASSEMBLY

(76) Inventor: Robert Johnson, 55-51308 Range Road 224, Alberta (CA) T8C 1H3

( * ) Notice: Subject to any disclaimer, the term of this patent is extended or adjusted under 35 U.S.C. 154(b) by 365 days.

(21) Appl. No.: 11/409,608

(22) Filed: Apr. 24, 2006

(65) Prior Publication Data

US 2006/0283434 A1 Dec. 21, 2006

(30) Foreign Application Priority Data

Apr. 29, 2005 (CA) ..... 2507332

(51) Int. Cl.
*F16M 11/00* (2006.01)

(52) U.S. Cl. ..... 248/405; 248/351; 248/354.1

(58) Field of Classification Search ..... 248/405, 248/351, 354.1, 354.4; 74/89.15; 411/272, 411/276

See application file for complete search history.

(56) References Cited

U.S. PATENT DOCUMENTS

| | | | | | |
|---|---|---|---|---|---|
| 1,483,051 | A | * | 2/1924 | Saunders | 248/441.1 |
| 1,823,204 | A | * | 9/1931 | Long | 269/60 |
| 2,785,835 | A | * | 3/1957 | Brumfield | 246/453 |
| 4,316,316 | A | | 2/1982 | Kappenhagen | |
| 4,494,721 | A | * | 1/1985 | Trinkel et al. | 248/406.2 |
| 4,635,492 | A | * | 1/1987 | Uebelhart | 74/89.35 |
| 4,655,426 | A | * | 4/1987 | von Dulong et al. | 248/405 |
| 4,791,716 | A | | 12/1988 | Konrad | |
| 4,899,511 | A | | 2/1990 | Andersson et al. | |
| 5,335,471 | A | | 8/1994 | Kupiec | |
| 5,347,777 | A | | 9/1994 | Sudduth | |
| 5,400,994 | A | * | 3/1995 | Shawwaf et al. | 248/354.3 |
| 5,649,764 | A | * | 7/1997 | Strickland | 362/410 |
| 6,092,620 | A | | 7/2000 | Klim | |
| 7,024,743 | B2 | * | 4/2006 | Heaton | 29/271 |
| 7,685,689 | B1 | * | 3/2010 | Del Castello | 29/281.1 |
| 2006/0091277 | A1 | * | 5/2006 | Wang | 248/405 |

FOREIGN PATENT DOCUMENTS

| | | |
|---|---|---|
| CA | 2 320 656 | 9/1999 |
| CA | 2 237 261 | 12/2001 |
| GB | 918 199 | 2/1963 |

* cited by examiner

*Primary Examiner*—Amy J Sterling
(74) *Attorney, Agent, or Firm*—Davis & Bujold, P.L.L.C.

(57) ABSTRACT

A metal support column shipping assembly, including a metal tubular support column with a shaft protruding from a top end of the support column. A top plate is provided having an aperture extending therethrough adapted to engage a remote end of the shaft. A bottom plate is provided which has a collar adapted to engage a bottom end of the support column. The bottom plate also has an aperture extending therethrough. The assembly has the shaft extending through the aperture in the top plate and the aperture in the bottom plate. A nut positioned on the shaft prevents the top plate and the bottom plate from being removed from the shaft.

2 Claims, 3 Drawing Sheets

METAL SUPPORT COLUMN SHIPPING ASSEMBLY

FIELD OF THE INVENTION

The present invention relates to an assembly in which required components are shipped with a metal support column.

BACKGROUND OF THE INVENTION

Metal support columns used in the construction industry are load rated. In order to achieve the load rating, the support columns must be used with similarly load rated top plates and bottom plates. When a support column is used with the wrong top plates and bottom plates, premature failure may occur.

Some support columns are shipped with boxed plates, with others the top plates and bottom plates are shipped separately. Unfortunately, errors are occurring when the support columns are pulled from inventory and the support columns are being sent to job sites with the wrong set of top plates and bottom plates. Depending upon the degree of supervision provided at the job site, these errors may or may not be detected.

SUMMARY OF THE INVENTION

According to the present invention there is provided a metal support column shipping assembly including a metal tubular support column having a top end and a bottom end. The top end has an interior surface with internal threads defining an opening. A shaft is provided with an exterior surface having exterior threads. The shaft is positioned in and protrudes from the opening at the top end of the support column, with the exterior threads engaging the internal threads. A length of that portion of the shaft protruding from the top end of the support column is adjustable by rotating the shaft. A bottom plate is provided having a collar adapted to engage a bottom end of the support column. The bottom plate has an aperture extending therethrough. A top plate is provided which is adapted to engage a remote of the shaft. The top plate also has an aperture extending therethrough. The assembly has the shaft extended through the aperture in the top plate and the aperture in the bottom plate. A nut positioned on the shaft prevents the top plate and the bottom plate from being removed from the shaft. As will hereinafter be further described, the nut also serves to bear the weight of the top plate during subsequent installation.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
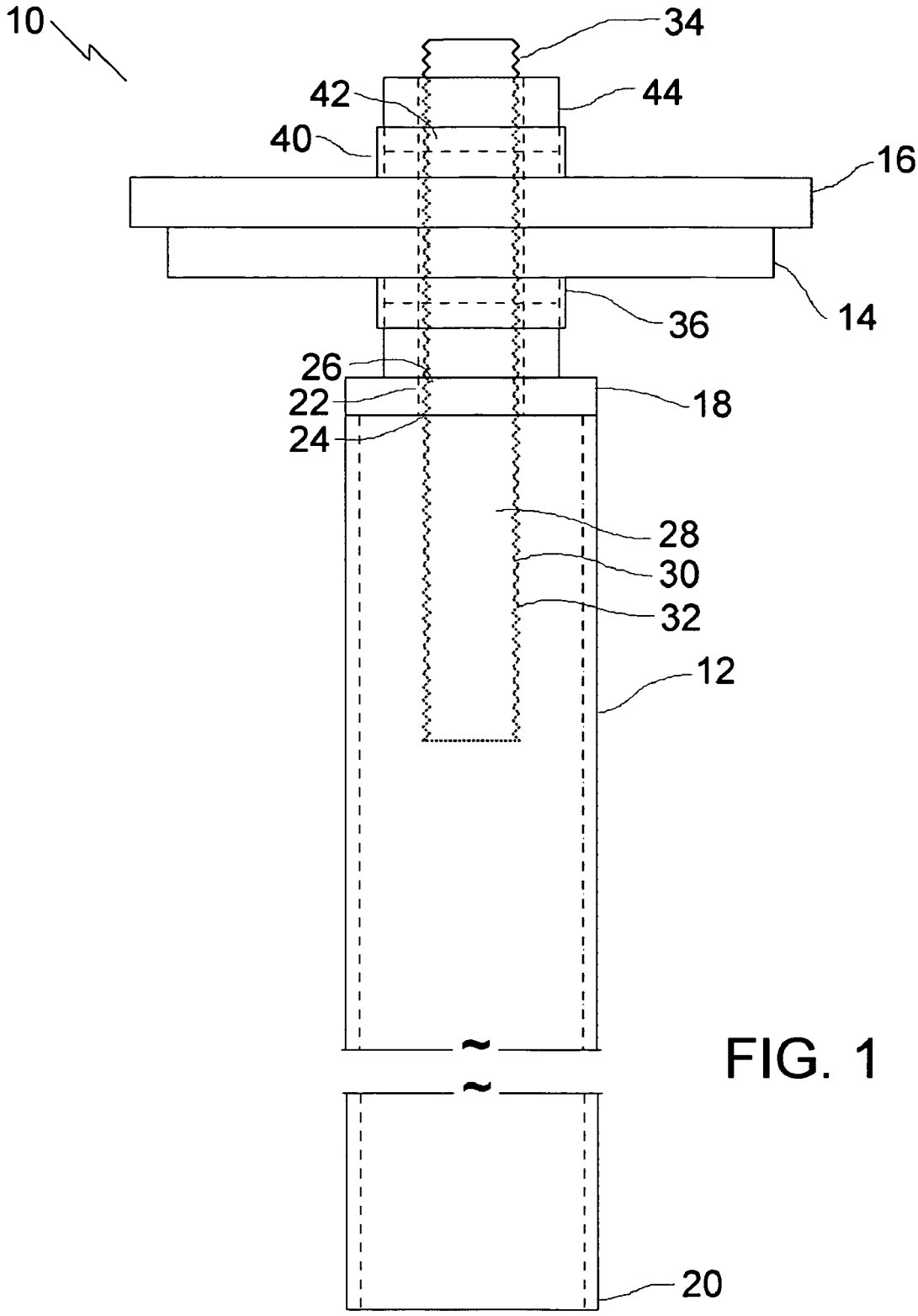
FIG. 1 is a side elevation view, in section, of a metal support column shipping assembly constructed in accordance with the teachings of the present invention.

The preferred embodiment, a metal support column shipping assembly generally identified by reference numeral 10, will now be described with reference to FIG. 1 through FIG. 3.

Structure and Relationship of Parts:

Referring to FIG. 1, shipping assembly 10 includes a metal tubular support column 12, a top plate 14 and a bottom plate 16. It is preferred, but not essential that top plate 14 and bottom plate 16 be interchangeable. Support column 12 has a top end 18 and a bottom end 20. Top end 18 has an interior surface 22 with internal threads 24. Interior surface 22 defines an opening 26. A shaft 28 is provided with an exterior surface 30 having exterior threads 32. Shaft 28 is positioned in and protrudes from opening 26 at top end 18 of support column 12, with exterior threads 32 of shaft 28 engaging internal threads 24 of interior surface 22. A length of portion 34 of shaft 28 protruding from top end 18 of support column 12 is adjustable by rotating shaft 28. Top plate 14 has a collar 36. Referring to FIG. 2, when used in construction, collar 36 is adapted to engage a remote end 38 of shaft 28. Collar 36 does not play an active role in shipping assembly 10. Referring to FIG. 1, top plate 14 has an aperture 38 extending therethrough. Referring to FIG. 2, bottom plate 16 is adapted to engage bottom end 20 of support column 12 during construction installation. Bottom plate 16 has a raised engagement, which has been illustrated as being in the form of a collar 40. Bottom plate 16, also has an aperture 42 extending therethrough. As will hereinafter be further described, aperture 42 is solely for the purpose of incorporation of bottom plate 16 into shipping assembly 10 and plays no role in the use of bottom plate 16 during construction installation. A nut 44 is provided, which is adapted to engage shaft 28. Nut 44 serves two purposes. A first purpose is to secure the plates to support column 12 during shipment. A second purpose is to bear the weight of top plate 14 during installation.

Figure 3:
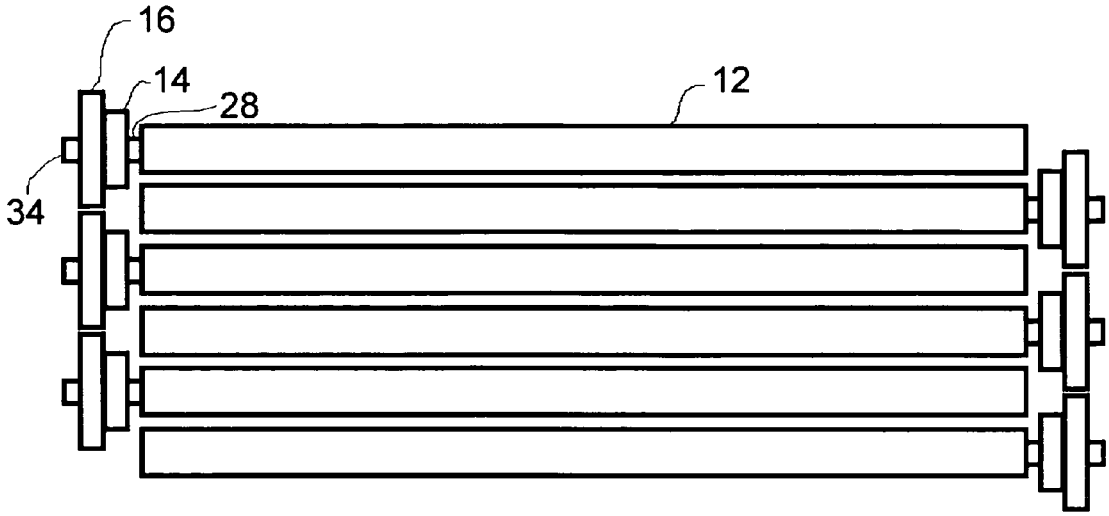
FIG. 3 is a side elevation view of a stack of the support columns illustrated in FIG. 1.

Referring to FIG. 3, when top plate 14 and bottom plate 16 are engaged on shaft 28, support column 12 may be stacked by alternating the direction of each successive support column 12 that is stacked on top, such that they may be closely packed without plates 14 and 16 interfering. In this manner, support columns 12 may be transported in a stable and tightly packed configuration.

Operation:

The use of metal support column shipping assembly 10 will now be described with reference to FIG. 1 through FIG. 3. Referring to FIG. 1, in preparation for shipment or placement into inventory, shaft 28 is extended through aperture 38 in top plate 14 and aperture 42 in bottom plate 16. Nut 44 is then positioned on shaft 28 to prevent top plate 14 and bottom plate 16 from being removed from shaft 28. It is recommended that nut 44 be placed in position with a torque wrench and sufficient torque applied to clamp top plate 14 and bottom plate 16 against top end 18 of support column 12. This holds all components tightly together, which facilitates stacking, reduces the risk of damage during shipment and eliminates the possibility of nut 44 becoming dislodged during handling or shipment due to vibration or incidental contact. The intent is to ensure that nut 44 is not removed, until someone intends it to be used immediately prior to use. Referring to FIG. 3, once prepared for shipment, support columns 12 are stacked by alternating the orientation of each successive support column 12 that is stacked, such that plates 14 and 16 do not prevent support columns 12 from being closely packed.

Figure 2:
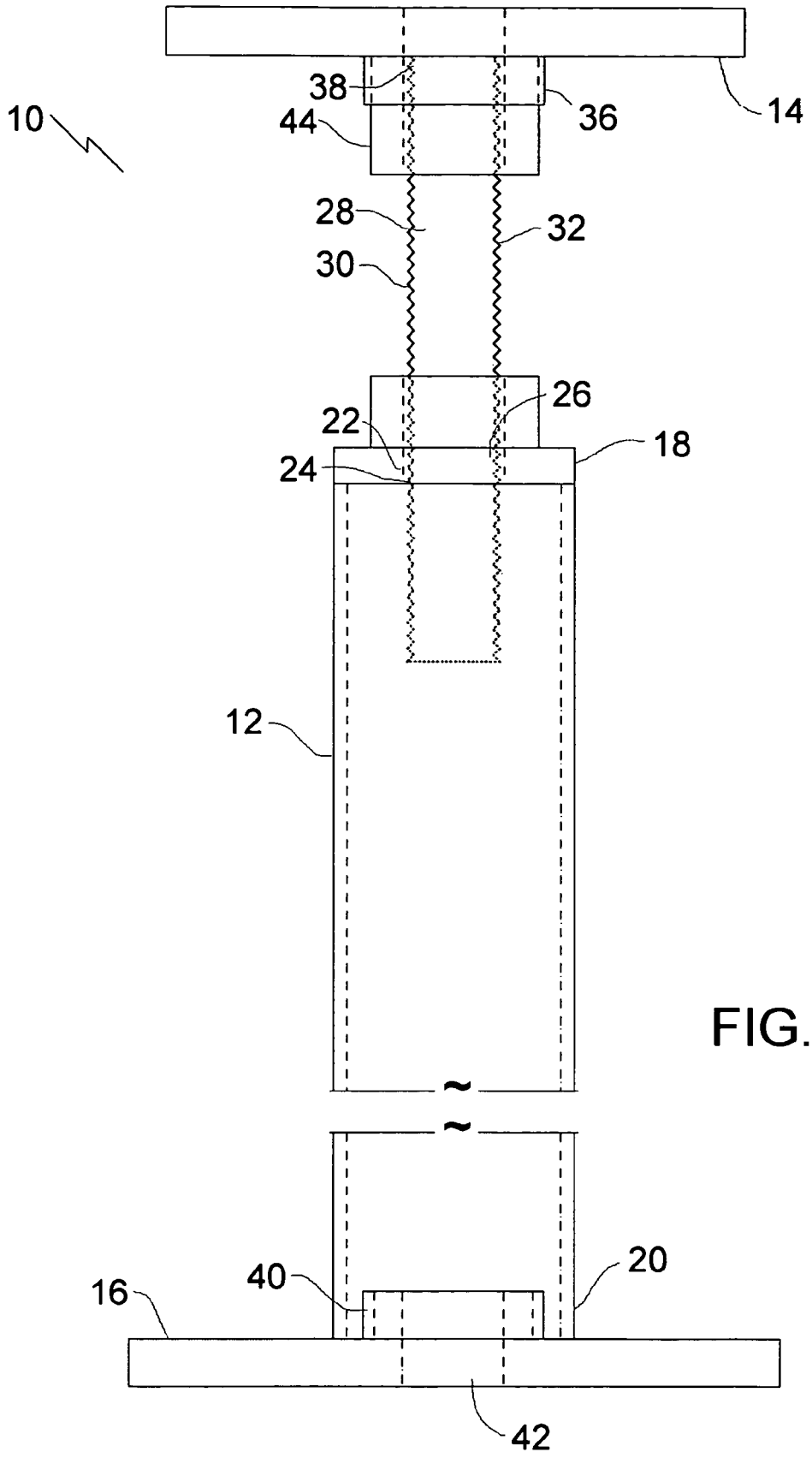
FIG. 2 is a side elevation view, in section, of the metal support column illustrated in FIG. 1, as it is used on a job site.

Referring to FIG. 2, there is illustrated how the components are assembled during construction installation. Bottom plate 16 engages bottom end 20 of support column 12, with collar 40 preventing lateral movement. Nut 44 is placed onto shaft 28 before top plate 14. As top plate 14 has aperture 38, nut 44 limits axial movement and bears the weight of top plate 14, ensuring that top plate 14 does not slide down exposing remote end 38 of shaft. Collar 36 of top plate 14 is adapted to engage a remote end 38 of shaft 28 and prevent relative lateral movement.

When the top plate and bottom plate are secured to the support column, as described above, errors are eliminated. It is also provides better inventory control, as the top plate and bottom plate are always with the column. It also facilitates outdoor storage. The system is simplified when the top plates and the bottom plates are made interchangeable.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A shipping assembly for a metal tubular support column having a top end and a bottom end, the top end having an interior surface with internal threads defining an opening, a shaft with an exterior surface having exterior threads being positioned in and protruding from the opening at the top end of the support column with the exterior threads engaging the internal threads, a length of that portion of the shaft protruding from the top end of the support column being adjustable by rotating the shaft, a top plate having opposed planar faces with an aperture extending therethrough between the opposed planar faces, and a collar positioned on one of the opposed planar faces surrounding the aperture, a bottom plate having opposed planar faces and a collar positioned on one of the opposed planar faces, a nut engaging the external threads on the shaft and supporting the top plate from below when a remote end of the shaft is extended through the aperture in the top plate, the collar on the top plate engaging the nut, the collar on the bottom plate engaging the bottom end of the support column, the shipping assembly comprising:

the bottom plate modified by an aperture extending therethrough between the opposed planar faces, the top plate and the bottom plate positioned back to back with collars oriented away from each other, the shaft extended through both the aperture in the top plate and the aperture in the bottom plate, and the nut clamping the top plate and the bottom plate against the top end of the support column.

2. A metal tubular support column comprising a top end and a bottom end, the top end having an interior surface with internal threads defining an opening, a shaft with an exterior surface having exterior threads being positioned in and protruding from the opening at the top end of the support column with the exterior threads engaging the internal threads, a length of that portion of the shaft protruding from the top end of the support column being adjustable by rotating the shaft, a top plate having opposed planar faces with an aperture extending therethrough between the opposed planar faces, and a collar positioned on one of the opposed planar faces surrounding the aperture, a bottom plate having opposed planar faces and a collar positioned on one of the opposed planar faces, a nut being engagable with the external threads on the shaft, the bottom plate having an aperture extending therethrough between the opposed planar faces, the support column being arrangeable in a shipping configuration or a construction configuration comprising, the support column in the shipping configuration comprises the shaft being partially threaded into the opening of the top end of the column, the top plate and the bottom plate being positioned such that a portion of the shaft passes through the apertures of the top and the bottom plates and extends therefrom, and the nut being securably engaged to an end of the portion of the shaft with the top and the bottom plates being supported on the shaft and clamped between the top end of the column and the nut.

* * * * *